United States Patent [19]

Boulos et al.

[11] Patent Number: 4,853,250

[45] Date of Patent: Aug. 1, 1989

[54] PROCESS OF DEPOSITING PARTICULATE MATERIAL ON A SUBSTRATE

[75] Inventors: Maher Boulos; Jerzy Jurewicz, both of Sherbrooke, Canada

[73] Assignee: Universite de Sherbrooke, Sherbrooke, Canada

[21] Appl. No.: 192,702

[22] Filed: May 11, 1988

[51] Int. Cl.[4] ..... B05D 3/06

[52] U.S. Cl. ..... 427/34; 427/38; 427/190; 427/191

[58] Field of Search ..... 427/34, 38, 190, 191

[56] References Cited

U.S. PATENT DOCUMENTS

| | | | |
|---|---|---|---|
| 4,207,360 | 6/1980 | Padovani | 427/213 |
| 4,517,495 | 5/1985 | Piepmeier | 315/111.21 |
| 4,621,183 | 11/1986 | Takeuchi et al. | 219/121 PC |
| 4,642,440 | 2/1987 | Schnackel et al. | 219/121 PP |
| 4,694,990 | 9/1987 | Karlsson et al. | 219/76 |

OTHER PUBLICATIONS

M. I. Boulos, Heating of Powders in the Fire Ball of an Induction Plasma, IEEE Transactions on Plasma Science, vol. PS-6 No. 2, 1978.

A. N. Babaevsky et al., Peculiarities of Spraying Coatings with a Radio-Frequency Induction Plasmatron, 10th Thermal Spraying Conf. 1983.

Toyonoby Yoshida, Particle Heating in a Radio-Frequency Plasma Torch, Journal of Applied Physics, vol. 48, No. 6, Jun. 1977.

Merle L. Thorpe, High-Temperature Heat with Induction Plasma, Research/Development Magazine, Jan. 1966.

Toyonobu Yoshida et al., New Design of a Radio-Frequency Plasma Torch, Plasma Chemistry & Plasma Processing, vol. 1, No. 1, 1981.

Thomas B. Reed, Growth of Refractory Crystals using the Induction Plasma Torch, Journal of Applied Physics, vol. 32, No. 12.

Thomas B. Reed, Induction-Coupled Plasma Torch, Journal of Applied Physics, vol. 32, No. 5, May 1961.

Lester A. Ettlinger et al., High-Temperature Plasma Technology Applications, Electrotechnology, vol. 6, Chapter 9.

Plasma Preparation of High-Purity Fused Silica, Electrotechnology, vol. 6, Chapter 5.

*Primary Examiner*—Bernard Pianalto

*Attorney, Agent, or Firm*—Cushman, Darby & Cushman

[57] ABSTRACT

The invention relates to a process and an apparatus for the plasma deposition of protective coatings and near net shape bodies using induction plasma technology. The apparatus comprises an induction plasma torch in which the particulate material to be deposited is accelerated and injected axially into the discharge. As the particles traverse the plasma they are heated and melted before being deposited by impaction on the substrate placed at the downstream end of the plasma torch facing the plasma jet.

5 Claims, 1 Drawing Sheet

PROCESS OF DEPOSITING PARTICULATE MATERIAL ON A SUBSTRATE

FIELD OF INVENTION

The present invention relates, in general, to an induction plasma system and a method for depositing particulate materials on a substrate. The invention finds applications in surface coatings, and the deposition of near net shape bodies.

BACKGROUND OF THE INVENTION

Plasma melting and deposition of particulate materials, be it ceramic or metallic powders has been known and used on an industrial scale since the late 60's and early 70's. Industrial plasma spraying devices are mostly of the DC type where an electric arc is established between a pair of electrodes to ionize a gas injected into the annular space between the electrodes. The body of plasma reaches very high temperatures, sufficient to melt the particulate material.

A common feature of the prior art devices is that the particulate material to be treated is injected in the plasma where it is heated, molten and accelerated to a relatively high velocity before impinging on the substrate on which the particulate material is to be deposited. The maximum velocity and temperature attained by the particles are limited by the velocity and the volume of the plasma body. DC plasma devices, giving rise to high velocity flows of the order of 100 to 300 m/s, are inherently small volume plasmas and can operate only at a small deposition rate. Therefore, these devices are ill suited for applications requiring high deposition rates.

An alternative to the DC plasma spraying device is the inductively coupled plasma apparatus which uses a radio frequency inductor coil for coupling energy into the plasma gas, instead of using electrodes. Inductively coupled plasmas are large volume plasmas, however, they give rise only to low gas velocities, of the order of 20 to 30 m/s.

An object of the present invention is an inductively coupled plasma apparatus for heating and depositing particulate material in which the particles travel at high velocities.

The object of the invention is achieved by providing an inductively coupled plasma torch in which the particles to be deposited are accelerated at a velocity higher than the velocity of the plasma gas flowing in the container, preferably of the order of 100 m/s or more, prior to their injection into the plasma body. The particles are injected in a low velocity, large volume induction plasma where they are heated and molten without much loss of their initial inertia and velocity.

In a preferred embodiment, the particles of material to be deposited are accelerated through viscous drag with a carrier gas traveling at a high velocity in a feed line leading to the plasma container. The carrier gas and the particles of material are injected in the plasma container, upstream of the body of plasma, in a direction generally parallel to the flow of plasma gas therein so that the particles pass through the body of plasma in the container, are heated, and then impinge on the substrate.

To prevent the local cooling and instability of the plasma which may be caused by the carrier gas injected at high velocity in the plasma container, the velocity of the carrier gas is reduced before the injection thereof in the plasma container. The velocity reduction is carried out by expanding the carrier gas in volume at the nozzle of the feed line. The expansion is performed suddenly, immediately before the carrier gas enters the plasma container to limit the residence time of the particulate material into a mass of low velocity carrier gas in the feed line nozzle, thus preventing a substantial reduction of the particles velocity.

The apparatus and the method, according to the present invention, find wide applications in the areas of deposition of metal, alloys and ceramic powders, remelting, titanium sponge melting as well as the forming of refractory ceramics and high purity materials, among others.

The present invention comprises, in a general aspect, a process for heating and depositing a particulate material on a substrate, the process comprising the steps of:

flowing ionizable plasma gas at a certain velocity in a plasma container along a longitudinal axis thereof;

inductively coupling energy to the plasma gas to create in the plasma container a body of plasma directed toward the substrate;

accelerating the particulate material to be deposited on the substrate to a velocity higher than the velocity of the plasma gas flowing in the plasma container; and feeding the particulate material in the plasma container along a longitudinal axis thereof, wherein the particulate material is heated while passing in the body of plasma at a velocity higher than the velocity of the plasma gas and is deposited on the substrate.

The invention also comprehends an apparatus for heating and depositing a particulate material on a substrate, the apparatus comprising;

a plasma container having an open end facing the substrate;

first inlet means on the plasma container to supply ionizable plasma gas at a certain velocity in the plasma container flowing along a longitudinal axis thereof;

inductor means mounted on the plasma container for coupling energy to the plasma gas to sustain a body of plasma in the plasma container;

particulate material supply means communicating with the container for supplying therein the particulate material along a longitudinal axis thereof, the particulate material supply means comprising means for accelerating the particulate material at a velocity higher than the velocity of the plasma gas in the plasma container.

BRIEF DESCRIPTION OF THE DRAWINGS

Throughout the drawings, the same reference numerals designate the same elements.

DESCRIPTION OF A PREFERRED EMBODIMENT

Figure 1:
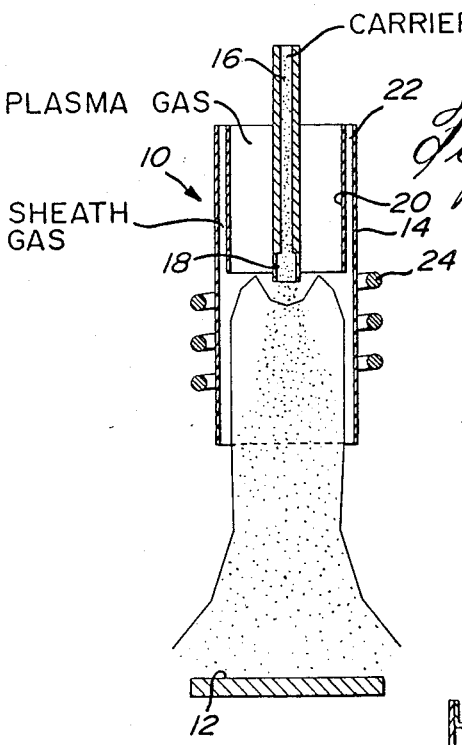
FIG. 1 illustrates schematically an induction plasma system, according to the invention.

Referring to the annexed drawings, more particularly to FIG. 1, the reference numeral 10 identifies, in general, an induction plasma system used for heating a particulate material to be deposited on a substrate 12. The type of particulate material, as well as the substrate 12, which may be a surface or a body to be coated, will vary widely according to the applications. However, in most cases the particulate material will be of metallic or of ceramic nature because, those are very difficult to melt and sprayed with other techniques.

The induction plasma system 10 comprises a tubular container 14 made of heat resistant material such as quartz, the lower end of the container 14 facing the substrate 12 on which the particulate material is to be deposited.

Ionizable plasma gas and the particulate material to be treated are injected through the upper end of the container 14. The plasma gas is supplied in the container 14, from a pressurized supply bottle, through the appropriate valving and tubing. The plasma gas supply pressure, its flow rate as well as its composition are technicalities mastered by those skilled in the art and are selected according to the intended application.

The particulate material to be treated is supplied in powder form through a feed tube 16 provided with a discharge nozzle 18. The particulate material is carried and accelerated through viscous drag with a carrier gas injected in the feed tube 16 at a high velocity for accelerating the particles to a velocity preferably substantially higher than the velocity of the plasma gas in the container 14.

Figure 3:
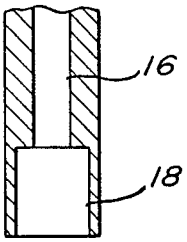
FIG. 3 is an enlarged cross-sectional view of a powder feed tube.

As best shown in FIG. 3, the feed tube 16 comprises an enlarged end portion defining a nozzle 18 to cause a reduction in the velocity of the carrier gas immediately prior the injection thereof in the plasma container 14. The ratio between the cross-sectional area of the nozzle 18 and cross-sectional area of the portion of feed tube 16 above the nozzle 18 will determine the velocity reduction of the carrier gas and this ratio is selected according to the application.

Within the plasma container 14, in the upper part thereof is mounted concentrically, a cylindrical member 20 through which flows plasma gas, whose diameter is slightly less than the diameter of the plasma container 14, to define an annular zone 22, to channel sheath gas for cooling the inner walls of the plasma container 14.

On the outside of the plasma container 14 is mounted an inductor coil 24 for coupling energy to the plasma gas. The inductor coil 24 is made of copper wire connected to a power supply system (not shown in the drawings) for circulating electric current in the inductor coil 24 at a frequency in the radio frequency range of the spectrum.

Figure 2:
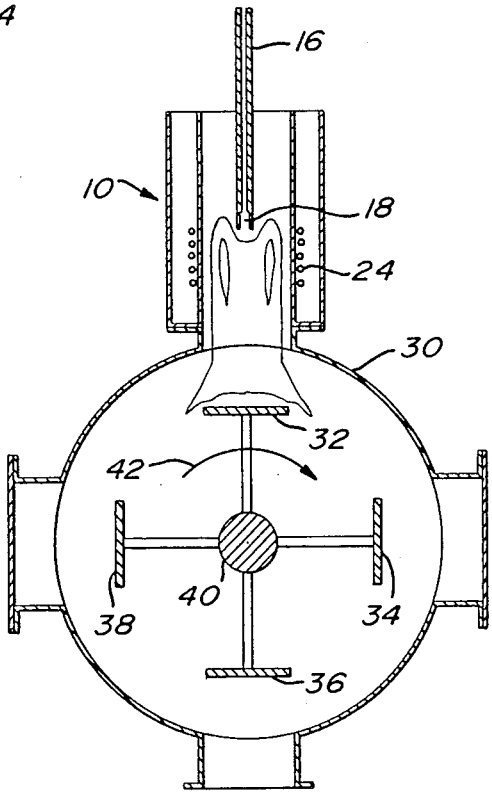
FIG. 2 illustrates schematically an experimental setup for coating a substrate, according to the present invention.

The substrate 12 is mounted stationary with respect to the plasma container 14, or for certain applications, it may be movable. The set-up shown in FIG. 2, is an example of an arrangement for moving the substrate with respect to the plasma container 14 and also permitting to coat simultaneously a plurality of substrates.

The plasma container 14 is mounted on a deposition chamber 30, in which are placed four substrates 32, 34, 36 and 38, supported on a swivel 40, that can rotate in the direction shown by the arrow 42 to sequentially expose each substrate to the stream of particulate material from the plasma torch, and that can also move in translation horizontally.

The deposition chamber 30 is opened at the bottom to allow gases from the plasma torch to escape.

DESCRIPTION OF A TYPICAL R.F. PLASMA SPRAYING OPERATION

1. Preparation of the substrate

In the procedure, both flat and cylindrical substrates were used. The former were of mild steel or stainless steel square plates (100×100 mm), 2 to 3 mm thick. The cylindrical substrates were mostly of mild steel in the form of a 50 mm internal diameter short cylinder, 150 mm long, with a wall thickness of about 1 mm.

In spray coating operations, for the purpose of depositing a protective layer, the surface on which the deposition is to be made was thoroughly cleaned and sandblasted prior to the operation. Whenever the deposition was carried out for the purpose of preparing near net shape bodies, the sandblasting step was not necessary since in these cases the substrate itself was machined out after the deposition step leaving the deposited material as a stand-alone piece.

2. Introduction of the substrate into the deposition chamber

Following the substrate preparation step, the samples on which the deposition is to be carried out were introduced into the deposition chamber, where they were fixed to the sample supporting system, shown in FIG. 2. This allowed the displacement of the samples under the plasma in a well defined manner involving either a reciprocating or rotating motion of the substrate holder, or a combination of both.

3. Ignition of the plasma

A 50.0 mm internal diameter induction plasma torch was used driven by a 3 MHz lepel r.f. power supply with a maximum plasma power of 25 kW. Plasma ignition was achieved, through the reduction of the ambient pressure in the plasma container and the deposition chamber to the level of a few torr in the presence of argon as the plasma gas. Following ignition, the plasma gas flow rates and the ambient pressure in the deposition chamber was raised and set to the required level. The operating conditions can be summarized as follow.

| Deposition chamber pressure = 175 torr | | |
|---|---|---|
| Plasma gas flow rates | | |
| powder carrier gas $Q_1$ | = | 4.0 liter/min (He) |
| plasma gas $Q_2$ | = | 31.0 liter/min (Ar) |
| sheath gas $Q_3$ | = | 68.0 liter/min (Ar) |
| | + | 5.6 liter/min ($H_2$) |
| Plasma plate power | = | 21.6 kW |

4. Plasma deposition operation

Following a brief sample heat-up period, the material to be deposited in powder form, was injected axially into the center of the plasma using a water-cooled, stainless steel, feed tube with a nozzle having an internal diameter of 9.5 mm, the internal diameter of the feed tube above the nozzle being of 2.5 mm. The powder feeding system used was of the screw feeder type, known in the art, which allowed the precise control of the powder feed rate. The powder is transported from the powder feeder to the injection probe using a 3.1 mm internal diameter pneumatic transport line. For the deposition of nickel on a steel substrate, nickel powder with a particle diameter in the range of 63 to 75 μm was used with a feed rate of 50 g/min. The distance between the tip of the powder injection nozzle and the substrate was set at 380 mm and the substrate was maintained in continuous motion under the plasma at a linear velocity of 160 mm/s. A typical deposition experiment lasted between 3 and 6 minutes.

5. Termination of the deposition operation

At the end of the deposition period, the powder feeder is stopped to interrupt the flow of the powder into the plasma. This is followed by the extinction of the plasma. The pressure in the deposition chamber is raised to the atmospheric pressure before turning off the plasma gas flow rates. This is followed by a cool-off period before opening the chamber to retrieve the samples.

Although the invention has been described with respect to a specific embodiment, it will be plain to those skilled in the art that it may be refined and modified in various ways. Therefore, it is wished to have it understood that the invention should not be interpreted in a limiting manner except by the terms of the following claims.

The embodiments of the invention in which an exclusive property or privilege is claimed are defined as follows:

1. A process for heating and depositing a particulate material on a substrate, said process comprising the steps of:

flowing ionizable plasma gas at a certain velocity in a plasma container along a longitudinal axis thereof;

inductively coupling energy to said plasma gas to create in said plasma container a body of plasma directed toward said substrate;

accelerating particulate material to be deposited on said substrate to a velocity higher than the velocity of said plasma gas flowing in said plasma container; and feeding said particulate material in said plasma container along a longitudinal axis thereof, wherein said particulate material is heated while passing in said body of plasma at a velocity higher than the velocity of said plasma gas and is deposited on said substrate.

2. A process as defined in claim 1, wherein said particulate material is accelerated to a velocity substantially higher than the velocity of said plasma gas.

3. A process as defined in claim 1, comprising the step of accelerating said particulate material through viscous drag with a carrier gas and injecting said particulate material and said carrier gas in said plasma container.

4. A process as defined in claim 1, further comprising the step of reducing the velocity of said carrier gas prior the injection thereof in said plasma container.

5. A process as defined in claim 4, comprising the step of expanding in volume said carrier gas prior the injection thereof in said plasma container.

* * * * *